US008100494B2

(12) United States Patent
Andrea et al.

(10) Patent No.: US 8,100,494 B2
(45) Date of Patent: Jan. 24, 2012

(54) METHOD OF PRINTING AND PRINTING SYSTEM

(75) Inventors: Alex Andrea, Barcelona (ES); Joan Jorba, Barcelona (ES); Sergio Puigardeu, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1032 days.

(21) Appl. No.: 12/010,603

(22) Filed: Jan. 28, 2008

(65) Prior Publication Data

US 2008/0192078 A1 Aug. 14, 2008

(30) Foreign Application Priority Data

Jan. 30, 2007 (EP) ..... 07101375

(51) Int. Cl.
*B41J 29/38* (2006.01)

(52) U.S. Cl. ..... 347/14; 347/15; 347/41

(58) Field of Classification Search ..... 347/9, 12, 347/15, 40, 41, 43, 14, 19, 20, 42, 49, 57, 347/84–86

See application file for complete search history.

(56) References Cited

U.S. PATENT DOCUMENTS 5,369,428 A * 11/1994 Maze et al. ..... 347/5
5,992,968 A 11/1999 Uetsuki et al.
6,247,787 B1 * 6/2001 Giere et al. ..... 347/40

FOREIGN PATENT DOCUMENTS

EP 1 418 053 5/2004

* cited by examiner

*Primary Examiner* — Thinh Nguyen

(57) ABSTRACT

A method of printing comprising: determining the position of ink marks on a medium resulting from the breakaway of secondary ink drops from primary ink drops; and positioning the primary ink drops on the medium using said determination.

19 Claims, 8 Drawing Sheets

METHOD OF PRINTING AND PRINTING SYSTEM

This application claims priority from European patent application 07101375.9, filed on Jan. 30, 2007. The entire content of the aforementioned application is incorporated herein by reference.

Aspects and embodiments of the invention are recited in the appended claims.

An embodiment of the invention uses a determination of the position of marks on a substrate resulting from the breakaway of secondary ink drops from primary ink drops in the positioning of the primary drops on the substrate.

An embodiment of the invention provides a method of printing an image on a print medium comprising:

- firing ink a plurality of times from a printhead such that, for at least some of the plurality of firings, each firing releases an ink drop which subsequently splits into a primary ink drop and at least one secondary ink drop which respectively produce a primary mark and at least one secondary mark on the medium;
- controlling the firing so that each of the primary marks corresponds to a pixel of the image;
- determining which of the secondary marks correspond to pixels of the image; and
- controlling the printhead so as not to produce primary marks at the same positions as said secondary marks that correspond to pixels of the image.

Said determining can be achieved by predicting the position of the secondary marks from data on the separation of the primary and secondary marks.

An embodiment of the invention provides a method of printing an image comprising releasing ink from a printhead to form ink marks on a medium wherein the ink is released a plurality of times to form pixels of the image on the medium, wherein each release of ink produces a primary mark on the medium at a position corresponding to an image pixel and one or more secondary marks, and from a knowledge of the position of the secondary marks the release of ink is controlled so that primary marks are not formed at positions on the medium occupied by the secondary marks.

An embodiment of the invention provides a printing system comprising: a printhead; a memory for storing data corresponding to a digital image which would result in a first pattern of firing ink jets during a printing operation; and a software product which takes the image data and produces a second pattern, different to the first pattern, of firing the ink jets during the print operation, the second pattern derived from the image data and from data related to positions at which secondary drops will fall during printing, the positions of secondary drops being used to modify the positions and/or timing of ink jet firing.

An embodiment of the invention provides a printing system comprising:

- a printhead operable to produce a plurality of ink ejections such that, for at least some of the ink ejections, each ink ejection produces a primary ink dot and one or more corresponding secondary ink dots on a print medium; and
- a processor for instructing the printhead, wherein the processor is configured to either instruct the printhead to modify the production of primary dots on the medium at positions at which secondary dots are predicted to occur or not to produce primary dots on the medium at positions at which secondary dots are predicted to occur.

In such an embodiment said modifying comprises reducing the size and/or optical density of said primary dots.

An embodiment of the invention provides a printer comprising:

- a printhead for ejecting ink;
- a processor for controlling the printhead such that under conditions in which each ink ejection from the printhead produces a primary ink spot and a secondary ink spot on a print medium the printhead is controlled by the processor so that primary ink spots are not produced on the medium at substantially the same positions as the secondary ink spots.

An embodiment of the invention provides a printer comprising: a printhead for ejecting ink; a support for positioning a print medium such that, in use, the print medium receives ejected ink from the printhead; and a processor for controlling the printhead, wherein,

- under conditions in which a single injection of ink from the printhead produces a primary ink dot and one or more secondary ink dots on the medium, the processor is configured to control the printhead such that, for a plurality of said single ink injections, primary ink dots are not produced on the medium at the positions on the medium of the secondary ink dots.

The processor may be present as part of a printer or in a separate device, e.g. a computer, which is in communication with the printer. Control of processing operations may be performed on a single processor or distributed across more than one processor (for example partly on-printer and partly off-printer).

An embodiment of the invention provides printing means operable to produce a plurality of ink ejections such that, for at least some of the ink ejections, each ink ejection produces a primary ink dot and one or more corresponding secondary ink dots on a print medium; and processing means for instructing the printing means, wherein the processing means is configured to instruct the printing means not to produce primary dots on the medium at positions at which secondary dots are predicted to occur.

An embodiment of the invention provides a computer program product for controlling the ejection of ink from a printhead so as to form an image on a print medium, the program comprising:

- instructions to determine, from received image data corresponding to an image, which pixels of said image will require ink when the image is printed;
- instructions to derive a separation of a primary ink spot and a secondary ink spot on a print medium that will be produced by at least some of a plurality of ink injections from the printhead; and
- instructions to cause the printhead to eject ink such that primary spots are produced which do not substantially coincide with secondary ink spots on the medium.

Embodiments of the invention use secondary marks as valid marks, rather than artifacts, when it is possible to do so.

It should be appreciated that embodiments and aspects of the invention that are defined in a particular category (e.g. a method) then the same embodiment or aspect can also be defined as other categories (e.g. as a printing system, a printer, or a computer program product). The skilled person will understand that the features and embodiments of the invention that are described and claimed may be combined in various ways.

SPECIFIC DESCRIPTION

Figure 1:
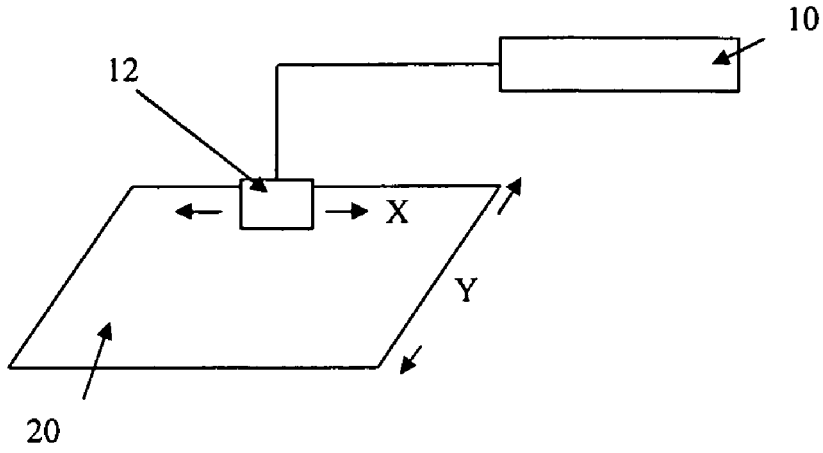
FIG. 1 schematically illustrates a print system according to an embodiment of the invention.
Figure 2:
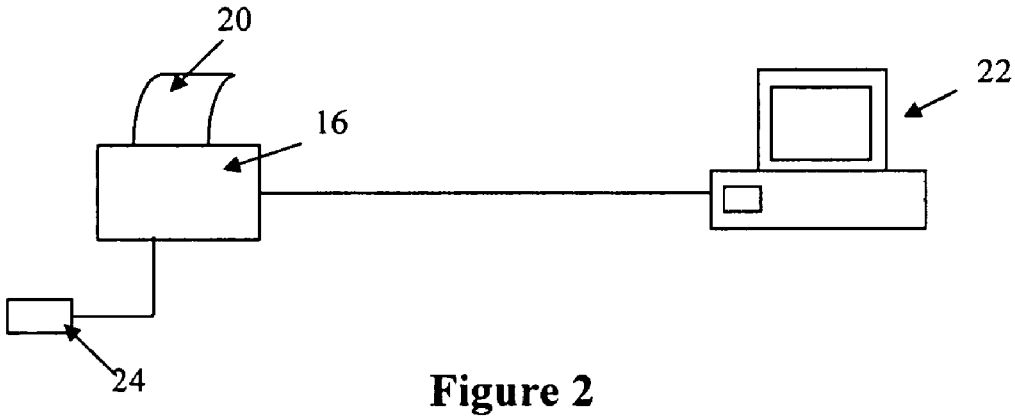
FIG. 2 schematically illustrates a first print system configuration according to an embodiment of the invention.
Figure 3:
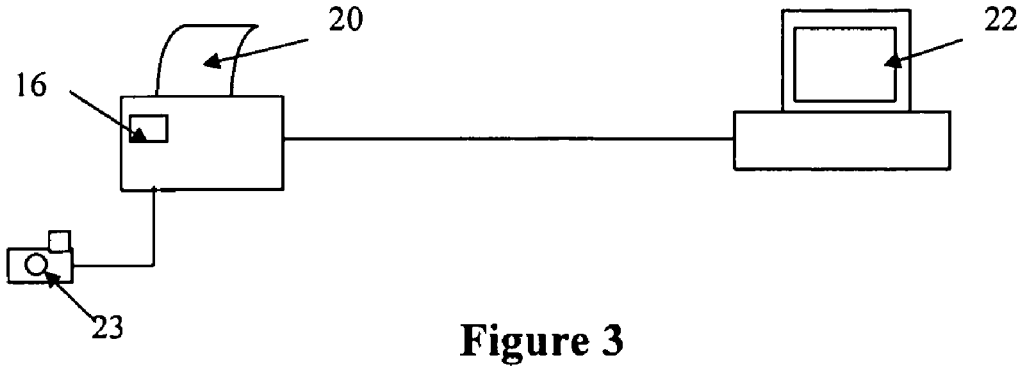
FIG. 3 schematically illustrates a second print system configuration according to an embodiment of the invention.

FIGS. 1 to 3 illustrate a printing system comprising a printhead 12 for ejecting ink on to a print medium 20 under the control of a print controller 10 to produce an image on the print medium 20. The printhead 12 is housed in a printer 16 and is moved in relation to the medium 20 as the printhead 12 ejects ink so that an image may be built up. Normally the printhead 12 is moved in a first linear direction, X, by a carriage and the medium 20 is moved from time to time in a second linear direction, Y, that is orthogonal to the first linear direction. The printer 16 may also have a configuration in which the image is built up by moving only one of the medium 20 and the printhead 12. In other configurations the printhead 12 and the medium 20 may be moved relative to each other in a fashion that is not linear.

For the purposes of describing an embodiment of the invention a unidirectional printmode will be considered in which ink is ejected from the printhead 12 as it moves across the medium 20 in one direction (eg from left to right in the usual writing direction) but does not eject ink in the return direction (eg the right to left direction). Between the passes in which the printhead 12 ejects ink the medium 20 is normally moved in the orthogonal direction, Y, so that another line of the image may be built up on the medium 20. Embodiments of the invention may also employ other printmodes, for example a bidirectional printmode may be used in which ink is delivered from the printhead 12 when it moves in both directions across the medium 10 (eg the printhead 12 delivers ink in both the left to right direction and the right to left direction with respect to the medium 20).

The print medium 20 is a substrate on which marks can be made with ink. Examples of such substrates include, but are not limited to, paper, card, fabric, acetate and other polymer films.

The print controller 10 generally comprises a processor and a memory. As shown in FIG. 2, the print controller 10 may be part of the printer 16 or, as shown in FIG. 3, it may be a separate unit that is housed in, for example, a computer 22 (such as a PC) which is in communication with the printer 16. Such a computer 22 may be in wired, fibre optic, or wireless communication with the printer 16. The print controller 10 may also be configured so that part of the print controller 10 (eg the processor) is part of the printer 16 whilst another part (eg the memory) of the print controller 10 is housed in the computer 22.

Although both FIGS. 2 and 3 illustrate a PC 22 such a PC 22 is not necessary for the operation of the printing system. For example the printer 16 may have one or more ports from which image data can be accessed, eg from a digital camera 23, a memory device 24 (eg a memory stick), or some other digital device that can store or transmit an image such as a mobile phone, MP3 player or similar device. Such devices may communicate the image by a wired or fibre optic link or by a wireless link or the devices may dock directly on to the printer 16. The printer 16 may also function as a fax machine, photocopier and/or a scanner. In this case the digital image may be scanned in or received by a facsimile from a phone line (either in wired or wireless connection to the printer 16). In some cases, in which the printer 16 is part of a networked system, the image data may be sent directly to the printer 16 by email.

Figure 4:
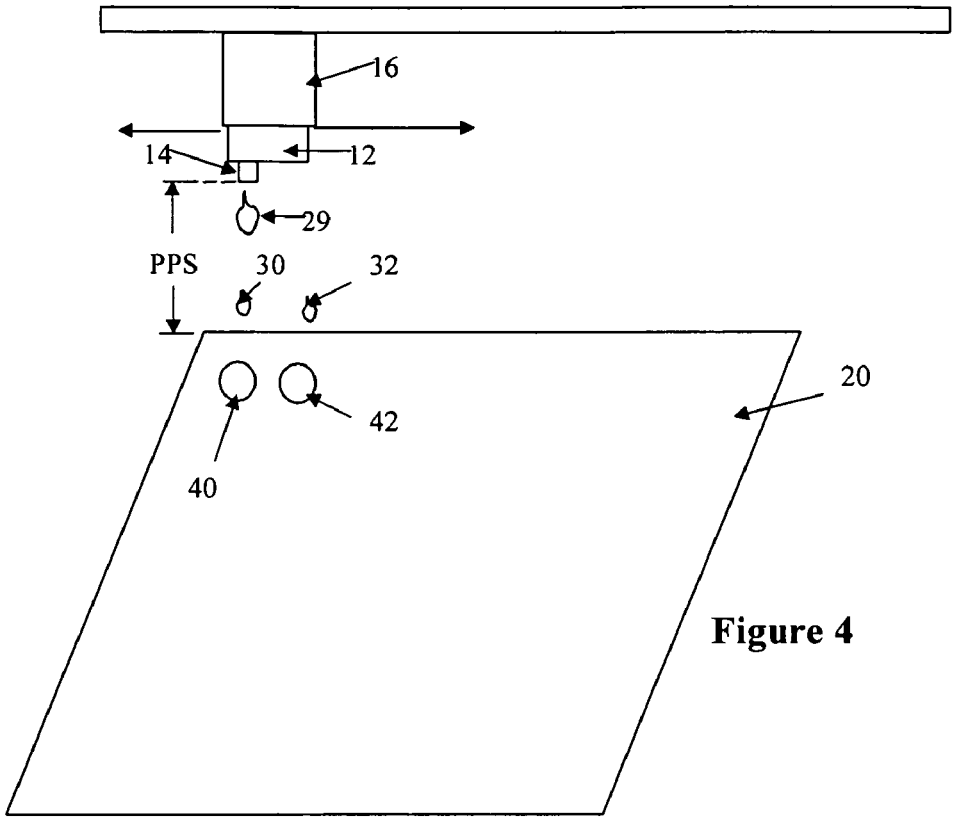
FIG. 4 schematically illustrates the production of multiple ink drops from a single ink ejection according to an embodiment of the invention.

Referring to FIG. 4, a printhead 12 is illustrated which is operated to move along a carriage guide 18. The printhead 12 generally has one or more nozzles 14 from which ink is ejected. Ink is ejected (fired) from a nozzle 14 to form an ink drop that subsequently lands on the medium 20 to form a visible ink mark on the medium 20. In some embodiments the ink may be invisible ink that forms visible marks after further processing. In this case the ink can still be considered to form visible marks albeit after further processing.

The ink marks may be referred to by the term "dots" in this specification, for example the term "dots per inch" (dpi) as is widely used in the printing arts. The term "dot" should not be taken to necessarily imply anything about the geometry of the marks, for example the marks may not necessarily be circular.

Generally the printhead 12 is controlled to print the image using a halftoning technique. Halftoning is the transformation of a greyscale or a colour image to a pattern of small dots with a limited number of colours (eg just black dots on a white background) in order to make it printable. Halftoning makes use of the inability of the human eye to distinguish small dots (such as those made by ink marks) at a distance. In the basic case of greyscale halftoning the halftone process creates a binary pattern of small black dots on a white background. If the dots are small enough, then instead of seeing dots a viewer will have the illusion of a grey tone the darkness of which will depend on the coverage of the black dots on the background. For example, more black dots or bigger black dots will create the illusion of a darker grey. Colour halftoning uses a limited ink set (for example cyan, magenta, yellow and black) and uses a dot pattern of these colours which are printed over each other. The colour the viewer will observe will depend on what dot pattern is used.

An image may be represented or stored as, for example, 8 bit channel data in which each pixel of the image is given an 8 bit value (0 to 255) that corresponds to the tone of that pixel. Of course the image may be represented or stored as higher or lower resolution data. By way of example, a halftone algorithm may convert 8 bits per channel data (i.e. the data representing the image to be printed) to 1 or 2 bits that usually represent the number of dots of ink that will be printed. The process causes a quantisation error that is due to the loss of information caused by the conversion of 8 bit data to 1 or 2 bit data. To overcome this quantisation error another algorithm can be used to approximate different shades of colour by distributing the dots of ink over an area. The more spaced the dots over the media the lighter the colour, the more closer the dots the darker the colour. A common type of algorithm to do this is a so-called "Error Diffusion" algorithm. Other types of algorithm are also well known in the art (such as Matrix-based, Pattern and Dither algorithms). The Error Diffusion technique will be described in more detail but it is pointed out that the invention is not necessarily limited to the use of any particular type of halftoning technique.

In the Error Diffusion technique the tone value of each pixel is determined and compared to a threshold value provided by the algorithm. If the tone value exceeds the threshold then an output is generated which is the difference between the tone value and the threshold (i.e. the error). This error value is distributed (diffused) between pixels that neighbour the pixel being examined. The error value assigned to each of theses neighbouring pixels is taken into account when the algorithm decides if a drop of ink is require for that pixel. For example, to print a medium grey shade the algorithm will assign a first dot to a first pixel and then when examining the next row it will determine there is already a dot in an adjacent pixel of that row so it would not put another dot next to the first dot but possibly a dot in the next pixel thereby forming a kind of chess table pattern.

Conventional halftone algorithms that are used to control the printhead 12 make the assumption that a single ink ejection from a nozzle 14 will produce a single ink mark on the medium 20 and that the ink mark will be circular.

Some current printheads eject ink drops that have very low drop volume so that small ink marks are created. The small ink marks, which can be of the order of a few tens of micrometers (or less) in diameter, are less noticeable to the human eye and the printed image will have less graininess. Such small ink drops are affected by aerodynamic effects produced by the movement of the printhead 12 along the carriage guide 18. At high carriage speeds the mark produced by the ink drop elongates and becomes non-circular. At a little higher carriage speeds, where aerodynamic effects are stronger, the ink drops split in the air and produces separated marks on the medium 20. The separation of the marks on the medium 20 will be determined by the separation of the printhead 12 from the medium 20. In the printing arts this separation is often referred to as the "Pen to Paper Spacing" (PPS) even when a pen is not used. For the purpose of this specific description the term "PPS" should be understood to mean the distance of the end of the printhead 12 to the medium 20.

FIG. 4 illustrates the aerodynamic effect of high carriage speed and low drop volume on the ink ejected from a nozzle 14. The ejected ink 29 splits into two drops 30, 32 which respectively produce two ink marks 40, 42 on the medium 20. One mark can be considered a primary mark 40 produced from a primary drop 30 whilst the other mark can be considered to be a secondary or "satellite" mark 42 produced by a secondary (satellite) drop 32. For some parameters of carriage speed and drop volume the marks may have approximately equal size. Also the marks may have substantially equal optical densities, that is, one mark is not noticeably fainter than the other. It should be appreciated that the invention is not limited to cases where two separated drops of ink are produced or that the drops have an equal weight and embodiments of the invention can also be applied to cases where more than two drops are produced and/or the drops are not of equal weight.

Figure 5:
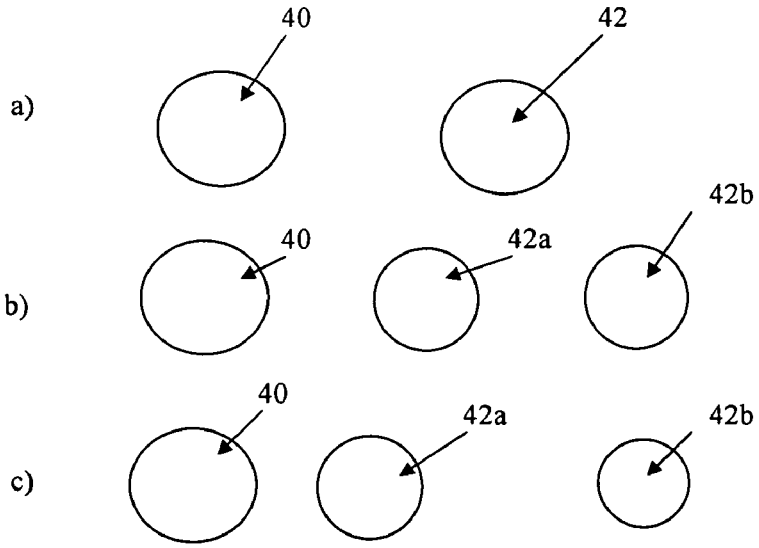
FIG. 5 schematically illustrates primary ink marks together with one or more secondary ink marks on a medium according to an embodiment of the invention.

FIG. 5 illustrates examples where more than one ink mark is produced by a single ink ejection. FIG. 5(*a*) illustrates two marks 40, 42 of approximately equal size. FIG. 5(*b*) illustrates a primary mark 40 and two equally separated secondary marks 42*a*, 42*b* with the secondary marks 42*a*, 42*b* being smaller than the primary mark 42 but equal in size to each other. FIG. 5(*c*) illustrates a primary mark 40 and two equally sized secondary marks 42*a*, 42*b* with the secondary marks 42*a*, 42*b* being smaller than the primary mark 40. In this case the distance between the two secondary marks 42*a*, 42*b* is greater than the separation of the primary mark 40 and the first secondary mark 42*a*. It will be appreciated that other combinations of ink mark sizes and spacings can occur and that more than three ink marks could be produced from a single ink ejection.

Printheads which eject drop volumes of about 4 to 6 picoliters, when used at carriage speeds higher than about 15-20 ips (inches per second) produce two separated dots of ink on the media about the same size as each other (about 2-3 picoliters in each drop). The unit of "inch per second" (ips) is approximately equivalent to 25.4 mm per second using SI units. Units of "inches per second" are used in this specification (rather than the SI equivalent unit) because they are widespreadly used in the printing arts. Similarly the unit of "dots per inch" (dpi) is used instead of the unit of "dots per millimetre".

Figure 6:
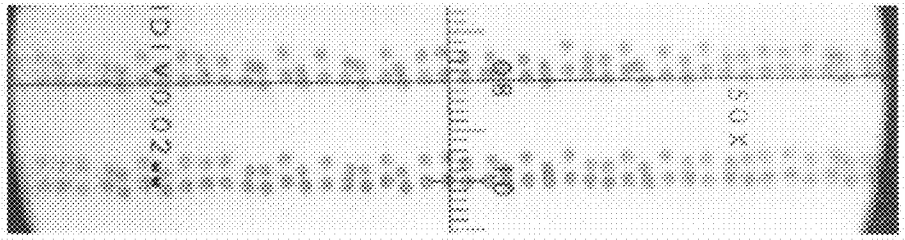
FIG. 6 is a micrograph of a printout produced with a carriage speed of 40 inches per second.
Figure 8:
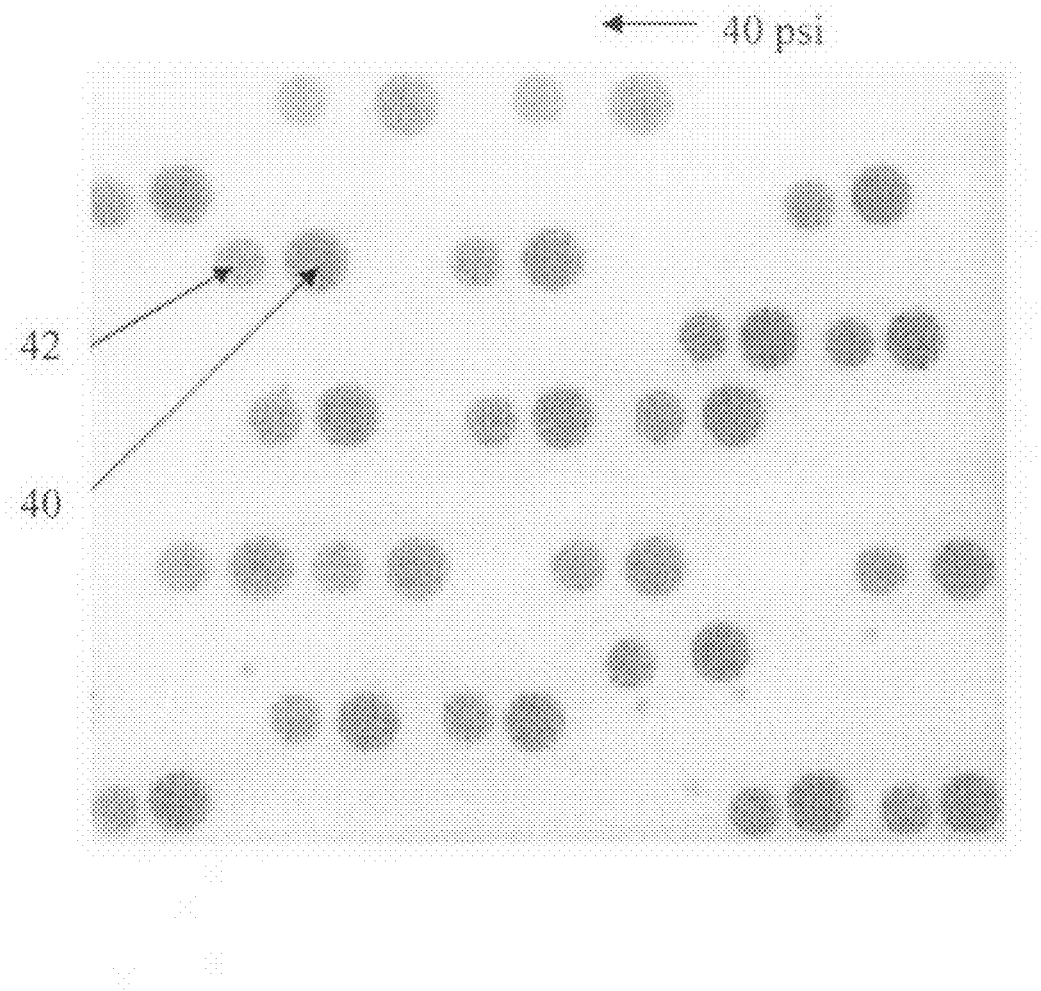
FIG. 8 is an enlarged view of a micrograph of a printout produced with a carriage speed of 40 inches per second.
Figure 9:
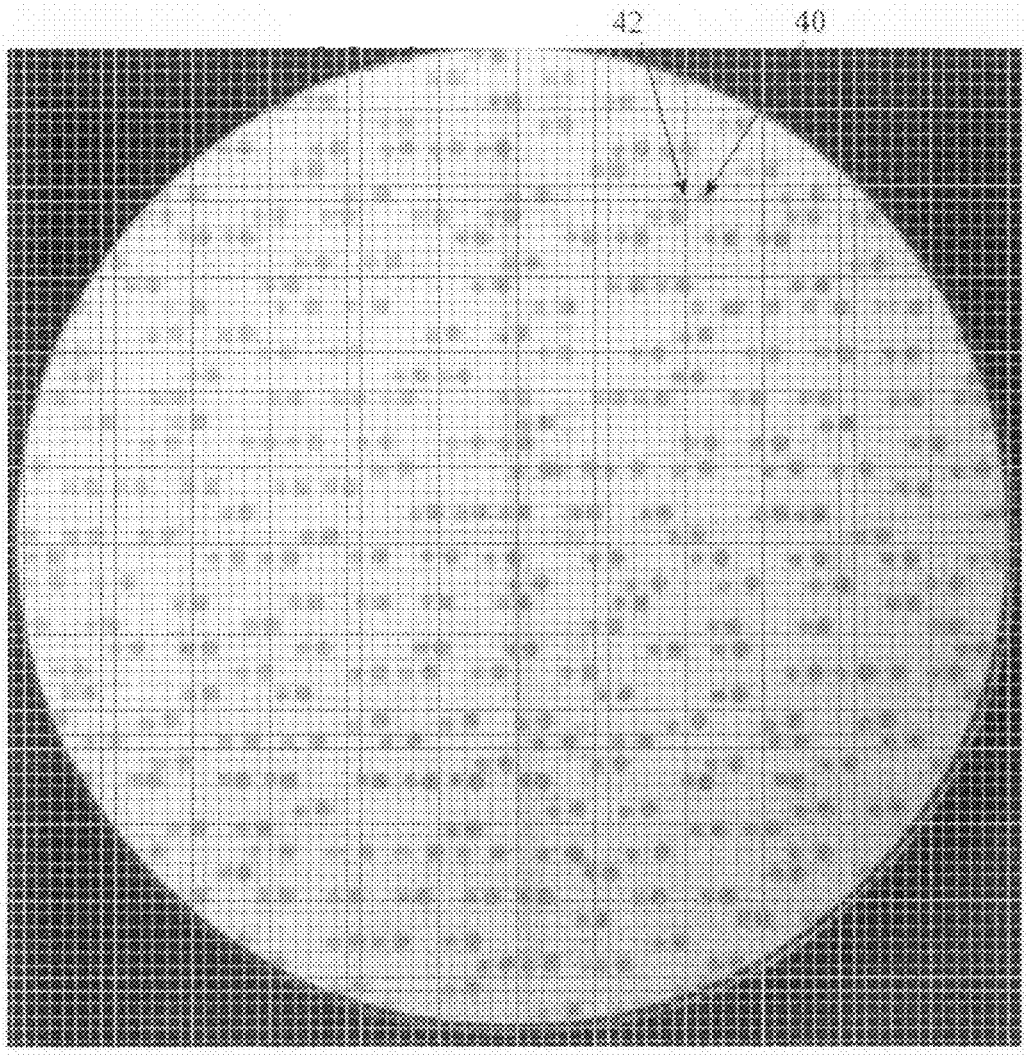
FIG. 9 is a micrograph of a printout produced with a carriage speed of 40 inches per second showing a 1200 dot per inch grid (pixel cells)

In one printhead that was tested, printing at a carriage speed of 40 ips and with a PPS of 1.5 mm and a drop volume of 6 picoliters, each fired drop becomes two printed marks on the medium 20, each mark having substantially the same size as each other and separated by 40 μm from each other (2 pixels away at a printing resolution of 1200 dpi). FIG. 6 is a micrograph of a printout from one such test whilst FIG. 8 is an enlarged view of a printout in which the primary marks 40 and secondary marks 42 are identified. FIG. 9 is a further micrograph of a printout using the same print parameters in which a 1200 dpi grid (pixel cells) is shown.

Figure 7:
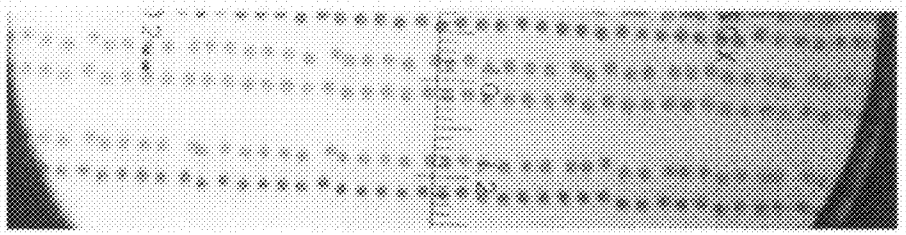
FIG. 7 is a micrograph of a printout produced with a carriage speed of 60 inches per second.

FIG. 7 is a micrograph of a printout of another test that was carried out with the same print parameters but with the carriage speed increased to 60 ips. In this case each drop splits to form two ink marks that have an average separation of 60 micrometers, this is equivalent to a separation of three pixels ("dots") at a printing resolution of 1200 dpi.

Conventional halftone methods ignore the effect of a fired drop splitting into two or more drops and producing two or more marks on a medium. The conventional printing technique assumes that just one ink drop hits the substrate at the pixel it was intended for. The splitting off of a secondary drop is ignored when printing other pixels of a printed image. In this case the additional, secondary, marks will appear as artifacts that will degrade the quality of the printed image. The carriage speed can be reduced to avoid aerodynamic effects but this directly reduces the overall speed of the printer. If the PPS could be reduced so that the distance between the printhead 12 and the medium 20 is narrower the fired (ejected) drop would not have time to split or if it splits the main drop (30) and the secondary drop (32) would land much closer together. However, the PPS is limited by media cockle (waviness produced in the medium due to ink water absorption) and it has a minimum value to avoid the carriage 18 touching the medium 20. The PPS value for large format printers has to be even higher.

According to an embodiment of the invention a new method of printing is used that controls the firing of ink from the printhead 12 to take into account the production of secondary marks 42 on the medium 20. The method makes use of the secondary marks 42 to form pixels of the printed image. Therefore, if it is determined that a secondary mark 42 will be produced at a position on the medium 20 that corresponds to a pixel of the image then the processor controls the printhead 12 so that it does not fire ink at this position on the medium 20.

This method produces more detailed printouts whilst keeping high printer throughput.

Generally the printer 16 will eject drops 29 of the same weight/volume for each firing from a nozzle 29 of the printhead 12. However, the printhead 12 could be configured and operated so that different ink drop weights can be chosen to be fired from the same printhead. In this way different pixels can be chosen to have different sizes of ink dot. Embodiments of the invention can still be used in this scenario. For example, if it has been predicted that a secondary mark 42 is present, or will be present, at the intended location on the medium 20 for an ink injection 29, the printhead 12 can be operated to fire a smaller ink ejection 29 than it would otherwise do. Therefore the printhead 12 can either be instructed to produce a modified ink primary mark 40 or no primary ink mark at all on the medium 20 at a position where a secondary mark 42 is predicted to occur.

The method uses the realisation that the secondary marks 42 are produced at predictable positions relative to the primary marks 40 and that the size of these secondary marks 42 is also substantially regular and/or does not matter too much. Generally the distance between a primary 40 and a secondary mark 42 is substantially constant or sufficiently within a narrow distribution about a mean distance. Similarly if there is more than one secondary mark 42 for each primary mark 40 then the distance between each of these secondary marks 42 and the primary marks 40 may be different (eg see FIG. 5) to each other but the distances remain substantially constant or predictable for each primary mark 40 considered. A table can be built up of the spacing between the primary 40 and the secondary marks 42 for different carriage speeds. Printers can be factory-set with such tables and/or the tables could be communicated to printers, or processors that control the printers, in the field. The printer 16 may be operated at different carriage speeds according to the printmode it is operated in (eg "draft", "quality", "photographic mode" etc) and the algorithm looks up the appropriate spacing between the primary and secondary marks from the table according to which printmode is being used. The spacing will also depend on the PPS and the drop size but these will often be constant for a particular printer 12 or may be determined by a calibration routine. In other instances the PPS and drop size are variables that can be controlled/measured. Parameters such as the ink density and viscosity can also affect the spacing of the marks 40, 42 but these are generally known/constant parameters once the printer design has been fixed.

The spacing may be determined by running a calibration routine on the printer/printing system which may, for example, be run periodically (e.g. when an ink cartridge is changed). The value of the spacing that is measured by the routine can be used rather than looking up the value from a table. Alternatively, the calibration routine may be used to give measured values of the spacing that are then used to populate or update data in a look-up table for subsequent use.

The spacing may be an experimental value that is determined from tests on a specific printer or a specific printer type with a specific set of printmode values. Such experimental values will generally be average values. Although the results of tests on a printer or printer type in a particular printmode may yield a distribution of values about an average, in general, the distribution is sufficiently narrow so that the positions of the secondary dots can be adequately predicted.

The spacing may also be determined theoretically or by a computer simulation, for example, using an equation or equations that operate on, for example, printmode parameters such as drop size, PPS and carriage speed. The spacing may also be determined by a combination of theoretically and experimental techniques, for example spacing values may be experimentally determined for a particular set of printmode values and further spacing may be calculated for other printmode values using an extrapolation technique. The spacing values may not necessarily be stored in a look-up table but may be calculated by a processor that then provides the information directly to a halftoning program.

An example implemented halftone algorithm takes account of the secondary marks using the distance between the primary and the secondary marks to calculate how to distribute the error, in an error-diffusion technique, among neighbouring pixels in the halftoning stage of the processing of the image data.

As an example, if the image data determines that two consecutive pixels in the printed image need to be filled the algorithm will only fire one drop instead of two because it predicts that the first drop will produce both a first mark 40 and a second mark 42 and both of the two consecutive pixels will be filled by the firing of a single ejection of ink. The algorithm may also use the size of the primary and secondary marks as parameters to calculate how to distribute the error amongst neighbouring pixels.

Figure 10:
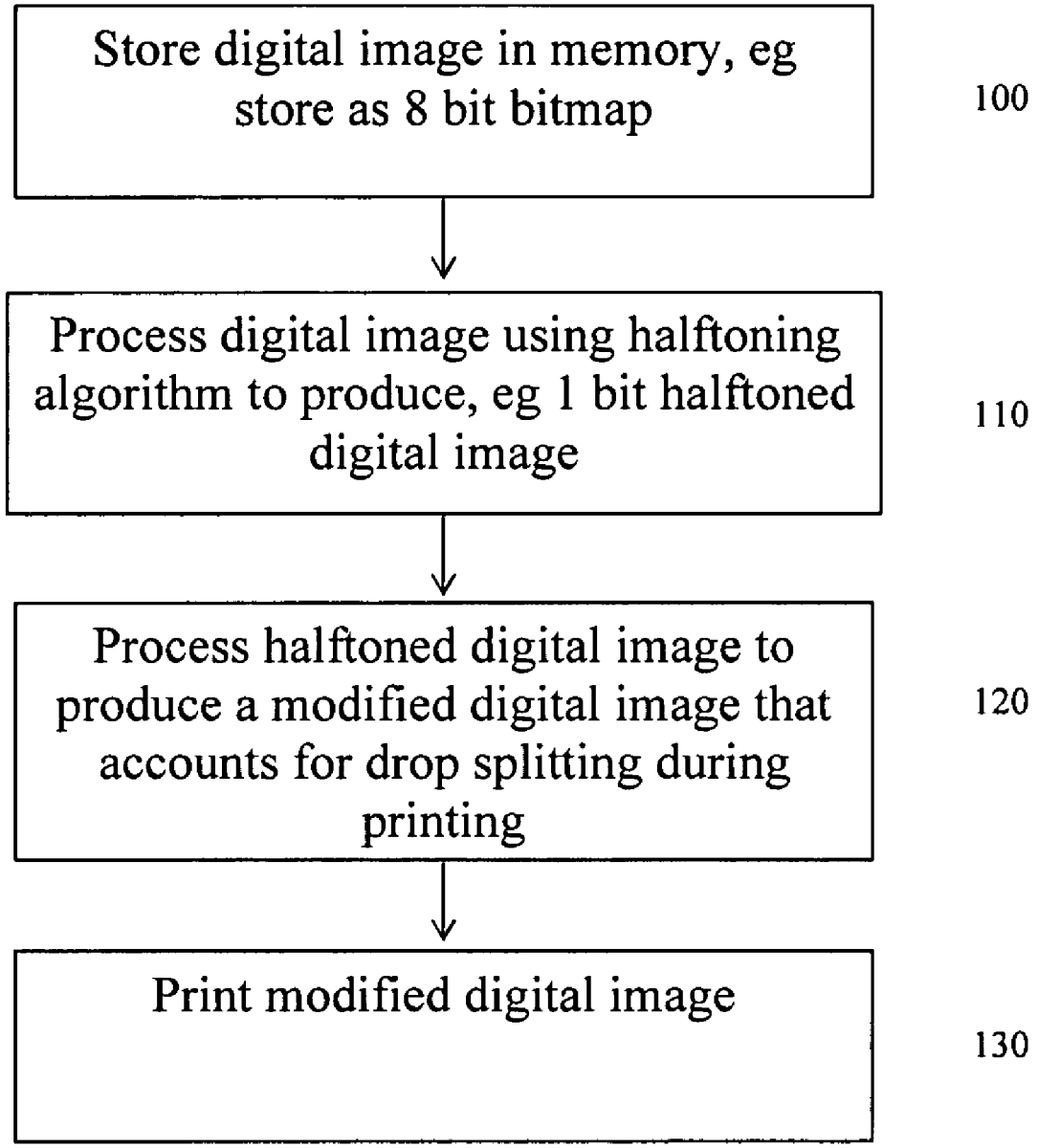
FIG. 10 is a flow diagram for a method according to an embodiment of the invention.
Figure 11:
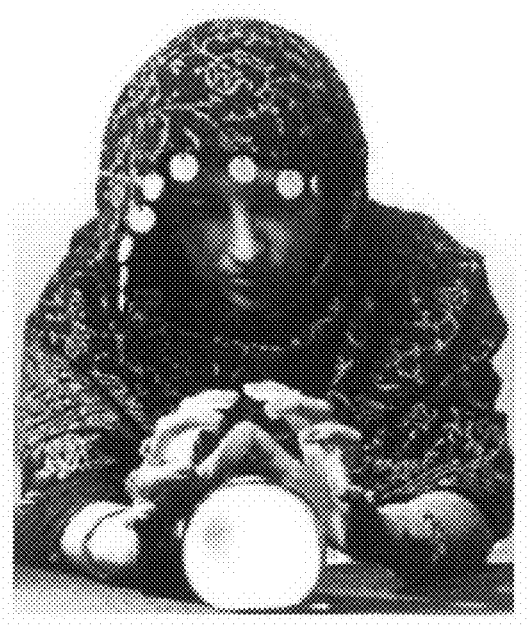
FIG. 11 illustrates an example of an original image stored in 8 bit greyscale with an image resolution of 100 dots per inch.

FIG. 10 is a flowchart that illustrates an embodiment of the invention. At step 100 a digital image is stored in a memory, this may be the memory of the controller 10 or a different memory. The digital image generally has (is stored with) a high resolution such as 8 bits per channel, that is each pixel of the image is given one of 256 values ($2^8$). The digital image may be, by way of example only, a photograph or a video still (video frame) but the invention is not necessarily limited to use with any particular type of image. FIG. 11 illustrates an example of an original image that is stored as a digital file using 8 bit greyscale.

Figure 12:
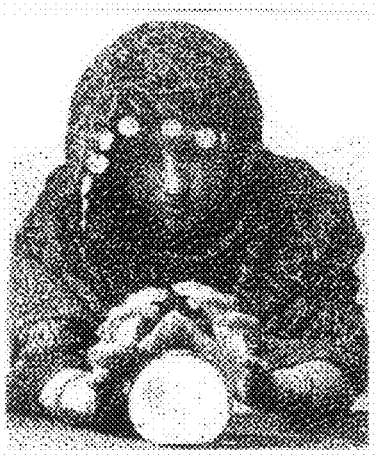
FIG. 12 illustrates how the image of FIG. 11 would appear when printed using halftoning if the ink drops used to create the image do not split.

At step 110 the digital image data is sent to a processor, for example the processor of the controller 10. A halftoning algorithm is applied to the digital data to produce halftone data, for example the digital image is represented using 1 bit per channel halftone data. FIG. 12 illustrates how the image of FIG. 11 should ideally be printed, i.e. with no artifacts due to the splitting of ink drops ejected from the printhead 12 and with each dot being perfectly shaped and filling the whole cell.

A prototype computer simulation has been used for fixed parameters for one real printmode. The distance between the primary 40 and secondary 42 marks used in the simulation where obtained from a real printer using printmode parameters with a carriage speed of 40 ips, a PPS of 1.5 mm and a drop volume of 6 picoliters. The printmode was unidirectional.

Figure 13:
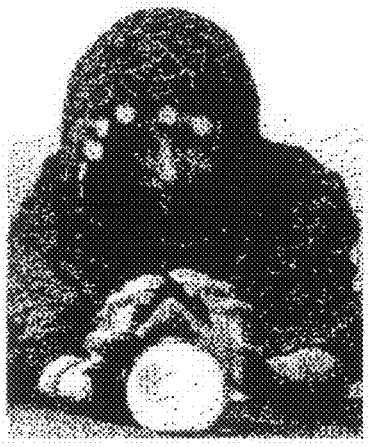
FIG. 13 illustrates the image of FIG. 11 when printed, according to the prior art, without compensating for secondary marks.

FIG. 13 illustrates the output printed image when the effect of ink drop splitting is not taken into account in the halftone algorithm. Pixels that should be white are filled by satellites (i.e. secondary marks 42) which results with the image having poor detail.

At step 120, according to one technique, the halftone data is further processed to produced modified halftone data. The modified halftone data assumes that marks 40 will have satellites (i.e. secondary marks 42). In view of this some pixels are left empty because the satellites will fill them during the printing phase.

It should be noted that modifying halftone data that does not account for splitting of ink drops is only an example of a technique that can be used for producing the required halftone data that accounts for the splitting (steps 110 and 120 with reference to FIG. 10). In another example technique an algorithm can act directly on the image data to produce the required halftone data (akin to combining steps 110 and 120 of FIG. 110).

Figure 14:
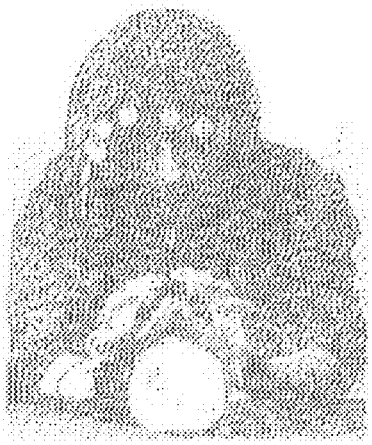
FIG. 14 illustrates a halftone image of the image of FIG. 11 using data that compensates for the production secondary marks according to an embodiment of the invention.
Figure 15:
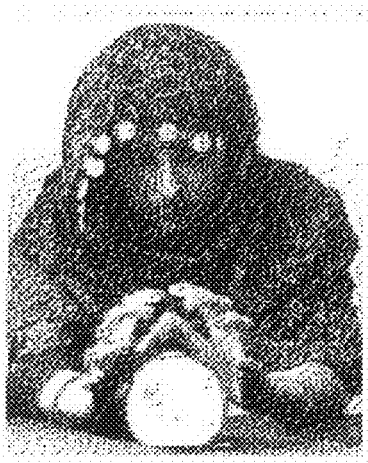
FIG. 15 illustrates the printed output produced using the halftone image illustrated in FIG. 14.

FIG. 14 represents the halftone data, where drop splitting is taken into account, as a one-bit image. At step 130 the halftone data is sent to the printhead 14. FIG. 15 illustrates how the halftone data represented in FIG. 14 would be printed when every drop ejected from the printhead 12 splits into two drops 30, 32 to produce two marks 40, 42 at a separation of two pixels distance. Pixels which were left empty are now filled by the expected secondary marks 42.

It can be seen that the printed image shown in FIG. 15, where drop splitting is accounted for, shows improved detail when compared to the printed image shown in FIG. 13, where drop splitting is not accounted for. Therefore, the original image shown in FIG. 11 can be printed at higher speeds whilst still maintaining the required print quality.

Although examples have been illustrated in which a unidirectional printmode has been used the invention is not limited to such a printmode. For example a bidirectional printmode can be used. In this case a knowledge of which nozzle(s) 14 will fire ink when the printhead 12 is travelling in each of the two print directions can be used to predict the positions of the secondary marks 42.

Thus, while the present invention has been described in terms of preferred embodiments, it will appreciated by one of ordinary skill that the spirit and scope of the invention is not limited to those embodiments, but extends to the various modifications and equivalents as defined in the appended claims.

We claim:

1. A method of printing comprising:

storing image data determining the position of secondary ink marks on a medium resulting from the breakaway of secondary ink drops from primary ink drops as a function printer operating parameters;

halftoning the image data using said determination to produce halftone data corresponding to a pattern of dots, said halftoning accounting for the secondary ink drops; and positioning the primary ink drops on the medium using said determination by ejecting ink on to the medium using said halftone data such that the printhead does not produce primary marks on the medium at positions at which secondary marks are determined to occur.

2. The method of claim 1, wherein said determining is performed by a processor and said positioning comprises operating a printhead in response to instructions from the processor, to eject ink a plurality of times such that, for at least some ink ejections, each ink ejection produces a primary ink drop and at least one secondary ink drop thereby producing a primary ink mark and at least one secondary ink mark on the medium.

3. The method of claim 2 wherein said determining uses a value of a predicted separation of the primary marks from the secondary marks.

4. The method of claim 3 wherein said value is stored in a memory as a function of the speed of the printhead across the medium during said positioning.

5. The method of claim 2 wherein the printhead carriage speed is at least 15 inches per second.

6. The method of claim 2 wherein the drop size is equal or less than 6 picoliters.

7. The method of claim 2 wherein the pen to paper separation is at least 1.5 mm.

8. The method of claim 1, in which half toning the image data comprises:

half toning the image data to produce halftone data; and modifying the halftone data using said determination to produce modified halftone data that accounts for secondary ink drops by:

identifying pixels in which the secondary ink drops are predicted to be deposited; and modifying the halftone data to leave pixels empty which will be filled by secondary ink droplets during printing.

9. A printing system comprising:

a printhead operable to produce a plurality of ink ejections such that, for at least some of the ink ejections, each ink ejection produces a primary ink dot and one or more corresponding secondary ink dots on a print medium; and a processor for instructing the printhead, wherein the processor is configured to instruct the printhead to modify the production of primary dots at positions at which secondary dots are predicted occur.

10. The printing system of claim 9 comprising a memory in communication with the processor, the memory holding predicted values of the separation of the secondary ink dots from the corresponding primary ink dots as a function of at least one printmode parameter, wherein the processor is configured to use said values to predict the positions on the medium at which the secondary dots occur.

11. The printing system of claim 10 wherein said at least one printmode parameter comprises the carriage speed of the printhead.

12. The printing system of claim 9 wherein the printing system is a printer.

13. The printing system of claim 9 comprising a memory holding a computer program for performing the following steps:

halftoning the image data to produce halftone data corresponding to a first pattern of dots;

modifying the halftone data using said determination to produce modified halftone data that corresponds to a second pattern of dots;

wherein said printhead is operable to eject ink on to the medium using said modified halftone data.

14. The printing system of claim 9, in which modify the production of primary dots at positions at which secondary dots are predicted occur comprises reducing the drop weight of ejected droplets.

15. The printing system of claim 9, in which modify the production of primary dots at positions at which secondary dots are predicted occur comprises not depositing primary dots at positions at which secondary dots are predicted to occur.

16. A computer program product for controlling the ejection of ink from a printhead so as to form an image on a print medium, the program comprising:

instructions to determine, from received image data corresponding to an image, which pixels of said image will require ink when the image is printed as a half tone image;

instructions to identify pixels which will receive ink as a result of a separation of a primary ink spot and a secondary ink spot on a print medium that will be produced by at least some of a plurality of ink injections from the printhead; and instructions to cause the printhead to eject ink, at least at times, such that primary spots are produced which do not substantially coincide with pixels which receive secondary ink spots on the medium.

17. The computer program of claim 16 wherein said instructions to identify a separation of a primary ink spot and a secondary ink spot comprise instructions to access a look-up table containing values of said separation versus values of printhead carriage speed.

18. The computer program of claim 16 wherein said instructions to identify comprise instructions to calculate the separation using one or more printmode values.

19. The computer program of claim 18 wherein the printmode values comprise values relating to the carriage speed, the size of the ink drop produced by each ejection and the separation of the printhead from the print medium.

* * * * *

UNITED STATES PATENT AND TRADEMARK OFFICE

CERTIFICATE OF CORRECTION

PATENT NO. : 8,100,494 B2
APPLICATION NO. : 12/010603
DATED : January 24, 2012
INVENTOR(S) : Alex Andrea et al.

It is certified that error appears in the above-identified patent and that said Letters Patent is hereby corrected as shown below:

In column 9, line 38, in Claim 1, delete “data” and insert -- data; --, therefor.

Signed and Sealed this
Sixteenth Day of October, 2012

David J. Kappos

David J. Kappos
*Director of the United States Patent and Trademark Office*